US012781744B2

(12) United States Patent
Feller et al.

(10) Patent No.: US 12,781,744 B2
(45) Date of Patent: Nov. 3, 2026

(54) METHOD FOR OPERATING STATUS DETERMINATION OF A REFRIGERANT COMPRESSOR/EXPANDER

(71) Applicant: BITZER Kuehlmaschinenbau GmbH, Sindelfingen (DE)

(72) Inventors: Klaus Feller, Herrenberg (DE); Roni Loerch, Neuenbuerg (DE); Tobias Hieble, Scheidegg (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 725 days.

(21) Appl. No.: 18/166,019

(22) Filed: Feb. 8, 2023

(65) Prior Publication Data

US 2023/0235936 A1 Jul. 27, 2023

Related U.S. Application Data

(63) Continuation of application No. PCT/EP2021/071902, filed on Aug. 5, 2021.

(30) Foreign Application Priority Data

Aug. 12, 2020 (DE) ..... 10 2020 121 260.7

(51) Int. Cl.
*F04C 28/28* (2006.01)
*F04C 2/16* (2006.01)
*F04C 14/28* (2006.01)

(52) U.S. Cl.
CPC ..... *F04C 28/28* (2013.01); *F04C 2/16* (2013.01); *F04C 14/28* (2013.01);
(Continued)

(58) Field of Classification Search
CPC .. F04C 2/16; F04C 14/28; F04C 28/28; F04C 2240/50; F04C 2270/16; F04C 2270/165
See application file for complete search history.

(56) References Cited

U.S. PATENT DOCUMENTS 6,238,188 B1 5/2001 Lifson
10,883,538 B2 * 1/2021 Sepe ..... F16C 19/522
(Continued)

FOREIGN PATENT DOCUMENTS

CN 107035692 A * 8/2017 ..... F04C 28/28
JP 2004125165 A * 4/2004
(Continued)

OTHER PUBLICATIONS

Koyo, basic Bearing Knowledge; 2021.*

*Primary Examiner* — Christopher S Bobish
(74) *Attorney, Agent, or Firm* — Reinhart Boerner Van Deuren P.C.

(57) ABSTRACT

In order to improve a method for operating status determination of a refrigerant compressor/expander comprising a compressor unit and a drive unit such that information on the operating status of a refrigerant compressor/expander which is as reliable as possible can be obtained, it is proposed that, for at least one bearing of the refrigerant compressor/expander, a load value resulting from an operation of said refrigerant compressor/expander and a speed value are determined and in that, on the basis of the speed value and the load value and also at least one operating parameter, there is determined for the at least one bearing an operating prediction value for a future maintenance-free operation of the refrigerant compressor/expander.

26 Claims, 7 Drawing Sheets

(52) U.S. Cl.
CPC ..... *F04C 2240/50* (2013.01); *F04C 2270/16* (2013.01); *F04C 2270/165* (2013.01)

(56) References Cited

U.S. PATENT DOCUMENTS

| | | | | |
|---|---|---|---|---|
| 2004/0018096 | A1* | 1/2004 | Lifson | F25B 49/005 417/53 |
| 2004/0261431 | A1* | 12/2004 | Singh | F25B 49/005 62/211 |
| 2005/0261141 | A1* | 11/2005 | Iso | F16C 33/6611 508/552 |
| 2014/0341710 | A1 | 11/2014 | Creamer | |
| 2016/0084734 | A1* | 3/2016 | May | F04D 15/0088 73/774 |
| 2016/0097572 | A1* | 4/2016 | Feller | F25B 31/026 418/201.1 |
| 2016/0265820 | A1 | 9/2016 | Groshek | |
| 2017/0051743 | A1 | 2/2017 | Sakai et al. | |
| 2017/0089598 | A1* | 3/2017 | Wallace | F24F 11/30 |
| 2025/0244205 | A1* | 7/2025 | Maruyama | F16C 19/364 |

FOREIGN PATENT DOCUMENTS

| | | | | |
|---|---|---|---|---|
| WO | WO-2013156068 | A1 * | 10/2013 | F16C 17/24 |
| WO | WO-2014174097 | A1 * | 10/2014 | F04D 15/0272 |
| WO | WO-2016005550 | A1 * | 1/2016 | F16C 19/00 |
| WO | WO-2019183262 | A1 * | 9/2019 | F04C 18/16 |
| WO | WO-2020132708 | A1 * | 7/2020 | F16C 19/522 |
| WO | WO-2020189398 | A1 * | 9/2020 | H02K 11/27 |
| WO | WO-2020255860 | A1 * | 12/2020 | F16C 19/02 |
| WO | WO-2023277193 | A1 * | 1/2023 | G01L 5/0019 |
| WO | WO-2025012314 | A1 * | 1/2025 | F16C 19/522 |

* cited by examiner

METHOD FOR OPERATING STATUS DETERMINATION OF A REFRIGERANT COMPRESSOR/EXPANDER

CROSS-REFERENCE TO RELATED PATENT APPLICATION

This application is a continuation of international application number PCT/EP2021/071902 filed on Aug. 5, 2021 and claims the benefit of German application number 10 2020 121 260.7 filed on Aug. 12, 2020.

The present disclosure relates to the subject matter disclosed in international application number PCT/EP2021/071902 of Aug. 5, 2021 and German application number 10 2020 121 260.7 of Aug. 12, 2020, which are incorporated herein by reference in their entirety and for all purposes.

BACKGROUND OF THE INVENTION

The invention relates to a method for operating status determination of a refrigerant compressor/expander comprising a compressor unit and a drive unit.

The operating status of a refrigerant compressor/expander is usually detected only on the basis of the operating time of the refrigerant compressor/expander.

When performing such a detection of the operating status of a refrigerant compressor/expander, however, it is not possible to identify what loads the refrigerant compressor/expander was exposed to during the operation.

In accordance with an embodiment of the invention, a method of the above-mentioned kind is improved in such a way that information on the operating status of a refrigerant compressor/expander can be detected as reliably as possible.

SUMMARY OF THE INVENTION

In accordance with an embodiment of the invention, provision is made in a method of the kind described at the outset that, for at least one bearing of the refrigerant compressor/expander, a load value resulting from an operation of said refrigerant compressor/expander and a speed value are determined and that, on the basis of the speed value and the load value and also at least one operating parameter, an operating prediction value for a future maintenance-free operation of the refrigerant compressor/expander is determined for the at least one bearing.

The advantage of the solution according to the invention can thus be considered to lie in the fact that it is thus possible to obtain information on the actual wear in the refrigerant compressor/expander caused by the load on the refrigerant compressor/expander during operation, this wear ultimately being decisive for determining how long the compressor can continue to run in maintenance-free operation.

On the premise that the refrigerant compressor/expander is operated according to manufacturer requirements, the operating prediction value obtained is thus a relatively reliable indicator for the future maintenance-free operation of the refrigerant compressor/expander.

In order to be able to determine the load of the refrigerant compressor/expander, it is preferably provided that the load value of at least one bearing, in particular at least one rolling bearing, is determined taking into account pressure and/or temperature values of the refrigerant compressor/expander.

The pressure and/or temperature values of a refrigerant compressor/expander make it possible to determine the mechanical load of the refrigerant compressor/expander, in particular of the compressor unit.

It is particularly favorable if the load value of the bearing is determined by detecting pressure and/or temperature values on a high-pressure side of the refrigerant compressor/expander and pressure and/or temperature values on a low-pressure side of the refrigerant compressor/expander, since in particular the pressure and/or temperature difference that can be determined between the high-pressure side and the low-pressure side of the refrigerant compressor/expander provides representative information on the mechanical load of the compressor unit and thus also of the refrigerant compressor/expander.

A particularly advantageous solution provides that the load value of the at least one bearing is determined taking into account the operation of the refrigerant compressor/expander with the statuses within the operating diagram.

This solution has the advantage that the individual statuses within the operating diagram provide meaningful information on the mechanical load of the compressor unit and thus of the refrigerant compressor/expander, thus providing a simple possibility for obtaining reliable information on the mechanical load occurring during operation.

Since the operating diagram comprises multiple operating statuses, each status could be associated with a load value within the operating diagram.

Since this would be very complex, a particularly advantageous and simplified solution provides that the operating diagram is divided within the operating limits into a plurality of operating zones having load values associated with them, and that, within the various operating zones, the load values associated with these operating zones are consulted during operation of the refrigerant compressor/expander.

This means that the multiple operating statuses can thus be associated with individual operating zones within the operating diagram and therefore just one load value is associated with each operating zone, such that the number of load values and thus also the effort for determining the various load values can be reduced.

In particular, the operating zones are defined such that each operating zone amalgamates those statuses for which the load values are greater than those of the respectively lower operating zone and for which the load values are smaller than those of the respectively higher operating zone.

Since the refrigerant compressor/expanders are not usually operated continuously in one operating status, but the operating statuses usually change multiple times and therefore the loads occurring also change multiple times, it is preferably provided that, on the basis of load values occurring in defined time intervals of the operation of the refrigerant compressor/expander, values for an operating period associated with these time intervals are determined.

In addition, it is preferably provided that, on the basis of speed values occurring in conjunction with time intervals of the operation of the refrigerant compressor/expander, values for an operating period associated with these time intervals are determined.

In the solution according to the invention, the operating prediction value can thus be determined in particular from the values for the operating period for the particular time intervals.

The time intervals are in particular successive time intervals during which the refrigerant compressor/expander is operated.

In order to determine the future operating period in the solution according to the invention on the basis of each time interval, it is preferably provided that for each time interval an operating period reduction value is determined from the value for the operating period and that the sum of all operating period reduction values of all time intervals is subtracted from a predefined operating period limit value defining a maximum operating period, in particular for a defined operating status.

The particular operating period reduction value is preferably based on a division of the particular operating period limit value by the operating period determined for the particular time interval.

Further factors could also be included in the operating period reduction value.

A particularly simple determination of the operating period prediction value is then possible when the particular operating period reduction value is determined by division of the operating period limit value by the operating period multiplied by the duration of the time interval.

In conjunction with the previously explained exemplary embodiments it was also mentioned that at least one operating parameter is additionally also included in the operating prediction value.

One solution provides that a lubricant-specific lubricant parameter is taken into account as an operating parameter when determining the operating prediction value.

Since the lubricant parameter is dependent on the temperature and the extent to which the refrigerant is dissolved in the lubricant, it is preferably provided that the lubricant parameter is determined on the basis of the pressure and/or the temperature on the high-pressure side of the refrigerant compressor/expander.

It is also preferably provided that the lubricant parameter is determined on the basis of the viscosity of the lubricant.

It is preferably additionally provided that, when determining the operating prediction value, at least one bearing parameter of the at least one selected bearing is taken into account as operating parameter.

A single parameter could be provided as bearing parameter.

In order to be able to take into account the form of the individual bearing, it is preferably provided that the bearing parameter for the at least one selected bearing comprises at least one of the parameters such as service life parameter, load rating parameter, and bearing type parameter.

It has not yet been discussed in greater detail in conjunction with the previously explained solution according to the invention which bearing of the refrigerant compressor/expander is selected.

An advantageous solution provides that the at least one selected bearing is a bearing of the refrigerant compressor/expander that takes up forces occurring during the compression of the refrigerant.

It is particularly expedient for the determination of an operating prediction if the at least one selected bearing is the bearing of the refrigerant compressor/expander with the highest mechanical load.

In order to incorporate the necessary safety when determining the operating prediction value, it is preferably provided that the at least one selected bearing is the bearing with the shortest envisaged service life, for example the bearing that has the least favorable ratio of load and load-bearing capacity, such that this bearing is the element which limits the operating period.

For example, the bearing is also selected such that it is the bearing with the smallest diameter.

In respect of the use of the determined operating prediction value, a wide range of different possibilities are conceivable.

For example, an advantageous solution provides that the operating prediction value and/or the operating periods determined for the individual time intervals are made available to an external memory.

Another advantageous solution provides that the operating prediction value is displayed on a display unit.

Here, the operating prediction value can be presented, for example, as a numerical value or as a bar chart, for example possibly even in relation to the operating period limit value, in order to predict graphically for an operator of the refrigerant compressor/expander according to the invention the possible future operating period in the simplest way possible.

A further advantageous solution provides that the operating prediction value is communicated to a superordinate control and/or monitoring unit; for example, a control and/or monitoring unit of this kind is the control and/or monitoring unit of an entire refrigeration plant which also specifies the operating mode for the particular refrigerant compressor/expander.

It can thus also be identified in the superordinate control and/or monitoring unit what further operating period can be realized with this refrigerant compressor/expander.

For example, when using a plurality of refrigerant compressors/expanders, the control and/or monitoring unit can operate the refrigerant compressor/expander having the best operating period prediction in an intensified manner and for example can operate a refrigerant compressor/expander having a lower operating period prediction less intensively, in order to thus synchronize the maintenance intervals for example in the case of multiple compressors.

Another advantageous solution provides that the operating prediction value is made accessible to the manufacturer of the refrigerant compressor/expander, for example by means of the external memory.

The manufacturer of the refrigerant compressor/expander thus likewise has the possibility to analyze the operation of the refrigerant compressor/expander and, if necessary, to schedule on its part maintenance intervals for this refrigerant compressor/expander (predictive maintenance).

The manufacturer of the refrigerant compressor/expander, however, may also determine more optimal operating conditions for the refrigerant compressor/expander on the basis of the operating period prediction and the operating periods determined for the individual time intervals, for example by simulations.

For example, the manufacturer of the refrigerant compressor/expander may use an optimized or virtual bearing for an analysis and may determine an operating prediction value on the basis of the optimized or virtual bearing and may compare this with the operating prediction value obtained from the refrigerant compressor/expander and, as appropriate, recommend or even use a bearing optimized in this way.

Alternatively or additionally, the manufacturer of the refrigerant compressor/expander may also compare the operating prediction value with virtually determined operating prediction values from virtual operating data.

Virtual operating parameters of this kind can be provided, for example, from other refrigerants or other lubricants, with which the possibility exists virtually to determine an operating prediction value which is then compared with the operating prediction value of the refrigerant compressor/expander actually in use in order to analyze whether an optimization of the maintenance intervals is possible on the basis of the other operating parameters.

The invention additionally relates to a refrigerant compressor/expander comprising a compressor unit and a drive unit, wherein the refrigerant compressor/expander is provided in accordance with the invention with an operating status determination module which comprises a processor which is configured such that it operates in accordance with one or more of the above method features.

The above description of solutions in accordance with the invention thus comprises in particular the various combinations of features defined by the following consecutively numbered embodiments:

1. A method for operating status determination of a refrigerant compressor/expander (10) comprising a compressor unit (18) and a drive unit (84), wherein, for at least one bearing (152) of the refrigerant compressor/expander (10), a load value (BW) resulting from an operation of said refrigerant compressor/expander (10) and a speed value (n) are determined, and wherein, on the basis of the speed value (n) and the load value (BW) and also at least one operating parameter (c, p, $a_i$, $a_1$, ZA), there is determined for the at least one bearing (152) an operating prediction value (BP) for a future maintenance-free operation of the refrigerant compressor/expander (10).
2. A method in accordance with embodiment 1, wherein the load value (BW) of the at least one bearing (152) is determined taking into account pressure and/or temperature values (PN, PH, TH) of the refrigerant compressor/expander.
3. A method in accordance with embodiment 1 or 2, wherein the load value (BW) of the bearing (152) is determined by detecting pressure and/or temperature values (PH, TH) on a high-pressure side of the refrigerant compressor/expander (18) and pressure and/or temperature values (PN) on a low-pressure side of the refrigerant compressor/expander (10).
4. A method in accordance with the preceding embodiments, wherein the load value (BW) of the at least one bearing (152) is determined taking into account the operation of the refrigerant compressor/expander (10) for the statuses within the operating diagram (E).
5. A method in accordance with the preceding embodiments, wherein the operating diagram (E) is divided within the operating limits (EG) into a plurality of operating zones (EZ) having load values (BW) associated with them, and wherein, within the various operating zones (EZ), the load values (BW) associated with these operating zones are consulted during operation of the refrigerant compressor/expander (10).
6. A method in accordance with the preceding embodiments, wherein, on the basis of load values (BW) occurring in conjunction with defined time intervals (Ix) of the operation of the refrigerant compressor/expander (10), values for an operating period (B) associated with these time intervals (Ix) are determined.
7. A method in accordance with the preceding embodiments, wherein, on the basis of speed values (n) occurring in conjunction with time intervals (Ix) of the operation of the refrigerant compressor/expander (10), values for an operating period (B) associated with these time intervals (Ix) are determined.
8. A method in accordance with the preceding embodiments, wherein the operating prediction value (BP) is determined from the values for the operating period (B) for the various successive time intervals (Ix).
9. A method in accordance with the preceding embodiments, wherein an operating period reduction value is determined for each time interval (Ix) from the value for the operating period (B), and wherein the sum of all operating period reduction values (BR) of all time intervals (Ix) is subtracted from a predefined operating period limit value (BG).
10. A method in accordance with the preceding embodiments, wherein the particular operating period reduction value (BR) is based on a division of the particular operating period limit value (BG) by the operating period (B).
11. A method in accordance with the preceding embodiments, wherein the particular operating period reduction value (BR) is determined by division of the operating period limit value (BG) by the operating period (B) multiplied by the duration (t) of the time interval (Ix).
12. A method in accordance with the preceding embodiments, wherein a lubricant-specific lubricant parameter (ai) is taken into account as an operating parameter when determining the operating prediction value (BP).
13. A method in accordance with the preceding embodiments, wherein the lubricant parameter (ai) is determined on the basis of the pressure (PH) and/or the temperature (TH) on the high-pressure side of the refrigerant compressor/expander (10).
14. A method in accordance with the preceding embodiments, wherein the lubricant parameter (ai) is determined on the basis of the viscosity of the lubricant.
15. A method in accordance with the preceding embodiments, wherein, when determining the operating prediction value (BP), at least one bearing parameter (C, P, a1) of the at least one selected bearing (152) is taken into account as operating parameter.
16. A method in accordance with the preceding embodiments, wherein the bearing parameter for the at least one selected bearing (152) comprises at least one of the parameters such as service life parameter (a1), load rating parameter (c), and bearing type parameter (p).
17. A method in accordance with the preceding embodiments, wherein the at least one selected bearing (152) is a bearing that takes up forces occurring during the compression of the refrigerant.
18. A method in accordance with the preceding embodiments, wherein the at least one selected bearing (152) is the bearing of the refrigerant compressor/expander (10) with the highest mechanical load.
19. A method in accordance with the preceding embodiments, wherein the at least one selected bearing (152) is the bearing with the shortest service life.
20. A method in accordance with the preceding embodiments, wherein the at least one selected bearing (152) is the bearing with the smallest diameter.
21. A method in accordance with the preceding embodiments, wherein the operating prediction value (BP) and/or the operating periods (B) determined for the individual time intervals (Ix) are made available in an external memory (230).
22. A method in accordance with the preceding embodiments, wherein the operating prediction value (BP) is displayed on a display unit (220).
23. A method in accordance with the preceding embodiments, wherein the operating prediction value (BP) is transmitted to a superordinate control and/or monitoring unit (240).

24. A method in accordance with the preceding embodiments, wherein the operating prediction value (BP) is made accessible to the manufacturer of the refrigerant compressor/expander (10).
25. A method in accordance with the preceding embodiments, wherein the operating prediction value (BP) is compared with operating prediction values of a virtual bearing.
26. A method in accordance with the preceding embodiments, wherein the operating prediction value (BP) is compared with virtual operating prediction values from virtual operating parameters.
27. A refrigerant compressor/expander (10) comprising a compressor unit (18) and a drive unit (84), wherein the refrigerant compressor/expander (10) comprises an operating status determination module (210) which comprises a processor (PRO) which is configured such that, for at least one bearing (152) of the refrigerant compressor/expander (10), a load value (BW) resulting from an operation of said refrigerant compressor/expander (10) and a speed value (n) are determined, and wherein, on the basis of the speed value (n) and the load value (BW) and also at least one operating parameter (c, p, ai, a1, ZA), there is determined for the at least one bearing (152) an operating prediction value (BP) for a future maintenance-free operation of the refrigerant compressor/expander (10).
28. A refrigerant compressor/expander in accordance with embodiment 27, wherein the operating status determination module (210) determines the load value (BW) of the bearing (152) taking into account pressure and/or temperature values (PN, PH, TH) of the refrigerant compressor/expander.
29. A refrigerant compressor/expander in accordance with embodiment 27 or 28, wherein the operating status determination module (210) determines the load value (BW) of the bearing (152) by detecting pressure and/or temperature values (PH, TH) on a high-pressure side of the refrigerant compressor/expander (18) and pressure and/or temperature values (PN) on a low-pressure side of the refrigerant compressor/expander (10) by means of sensors (212, 214, 216) provided for this purpose.
30. A refrigerant compressor/expander in accordance with embodiments 27 to 29, wherein the operating status determination module (210) determines the load value (BW) of the at least one bearing (152) taking into account the operation of the refrigerant compressor/expander (10) within the operating diagram (E) provided, in particular stored, in the operating status determination module (210).
31. A refrigerant compressor/expander in accordance with embodiments 27 to 30, wherein the operating diagram (E) is divided within the operating limits (EG) into a plurality of operating zones (EZ) having load values (BW) associated with them, and wherein, within the various operating zones (EZ), the load values (BW) associated with these operating zones are consulted during operation of the refrigerant compressor/expander (10).
32. A refrigerant compressor/expander in accordance with embodiments 27 to 31, wherein, on the basis of load values (BW) occurring in conjunction with defined time intervals (Ix) of the operation of the refrigerant compressor/expander (10), the operating status determination module (210) determines values for an operating period (B) associated with these time intervals (Ix).
33. A refrigerant compressor/expander in accordance with embodiments 27 to 32, wherein, on the basis of speed values (n) occurring in conjunction with time intervals (Ix) of the operation of the refrigerant compressor/expander (10), the operating status determination module (210) determines values for an operating period (B) associated with these time intervals (Ix).
34. A refrigerant compressor/expander in accordance with embodiments 27 to 33, wherein the operating status determination module (210) determines the operating prediction value (BP) from the values for the operating period (B) for the various successive time intervals (Ix).
35. A refrigerant compressor/expander in accordance with embodiments 27 to 34, wherein the operating status determination module (210) determines an operating period reduction value (BR) for each time interval (Ix) from the value for the operating period (B), and wherein the sum of all operating period reduction values (BR) of all time intervals (Ix) is subtracted from a predefined operating period limit value (BG).
36. A refrigerant compressor/expander in accordance with embodiments 27 to 35, wherein the particular operating period reduction value (BR) is based on a division of the particular operating period limit value (BG) by the operating period (B).
37. A refrigerant compressor/expander in accordance with embodiments 27 to 36, wherein the operating status determination module (210) determines the particular operating period reduction value (BR) by division of the operating period limit value (BG) by the operating period (B) multiplied by the duration (t) of the time interval (Ix).
38. A refrigerant compressor/expander in accordance with embodiments 27 to 37, wherein the operating status determination module (210) takes into account a lubricant-specific lubricant parameter (ai) as an operating parameter when determining the operating prediction value (BP).
39. A refrigerant compressor/expander in accordance with embodiments 27 to 38, wherein the operating status determination module (210) determines the lubricant parameter (ai) on the basis of the pressure (PH) and/or the temperature (TH) on the high-pressure side of the refrigerant compressor/expander (10).
40. A refrigerant compressor/expander in accordance with embodiments 27 to 39, wherein the operating status determination module (210) determines the lubricant parameter (ai) on the basis of the viscosity of the lubricant.
41. A refrigerant compressor/expander in accordance with embodiments 27 to 40, wherein the operating status determination module (210) takes into account at least one bearing parameter (C, P, a1) of the at least one selected bearing (152) as operating parameter when determining the operating prediction value (BP).
42. A refrigerant compressor/expander in accordance with embodiments 27 to 41, wherein the bearing parameter for the at least one selected bearing (152) comprises at least one of the parameters such as service life parameter (a1), load rating parameter (c), and bearing type parameter (p).
43. A refrigerant compressor/expander in accordance with embodiments 27 to 42, wherein the at least one selected bearing (152) is a bearing that takes up forces occurring during the compression of the refrigerant.

44. A refrigerant compressor/expander in accordance with embodiments 27 to 43, wherein the at least one selected bearing (152) is the bearing of the refrigerant compressor/expander (10) with the highest mechanical load.
45. A refrigerant compressor/expander in accordance with embodiments 27 to 44, wherein the at least one selected bearing (152) is the bearing with the shortest service life.
46. A refrigerant compressor/expander in accordance with embodiments 27 to 45, wherein the at least one selected bearing (152) is the bearing with the smallest diameter.
47. A refrigerant compressor/expander in accordance with embodiments 27 to 46, wherein the operating status determination module (210) makes available in an external memory (230) the operating prediction value (BP) and/or the operating periods (B) determined for the individual time intervals (Ix).
48. A refrigerant compressor/expander in accordance with embodiments 27 to 47, wherein the operating prediction value (BP) is displayed on a display unit (220).
49. A refrigerant compressor/expander in accordance with embodiments 27 to 48, wherein the operating status determination module (210) communicates the operating prediction value (BP) to a superordinate control and/or monitoring unit (240).
50. A refrigerant compressor/expander in accordance with embodiments 27 to 49, wherein the operating status determination module (210) communicates the operating prediction value (BP) to the manufacturer of the refrigerant compressor/expander (10).
51. A refrigerant compressor/expander in accordance with embodiments 27 to 50, wherein the operating prediction value (BP) is compared with operating prediction values of a virtual bearing.
52. A refrigerant compressor/expander in accordance with embodiments 27 to 51, wherein the operating prediction value (BP) is compared with virtual operating prediction values from virtual operating parameters.

Further features and advantages are the subject of the following description and the graphical representation of some exemplary embodiments:

DETAILED DESCRIPTION OF THE INVENTION

Figure 1:
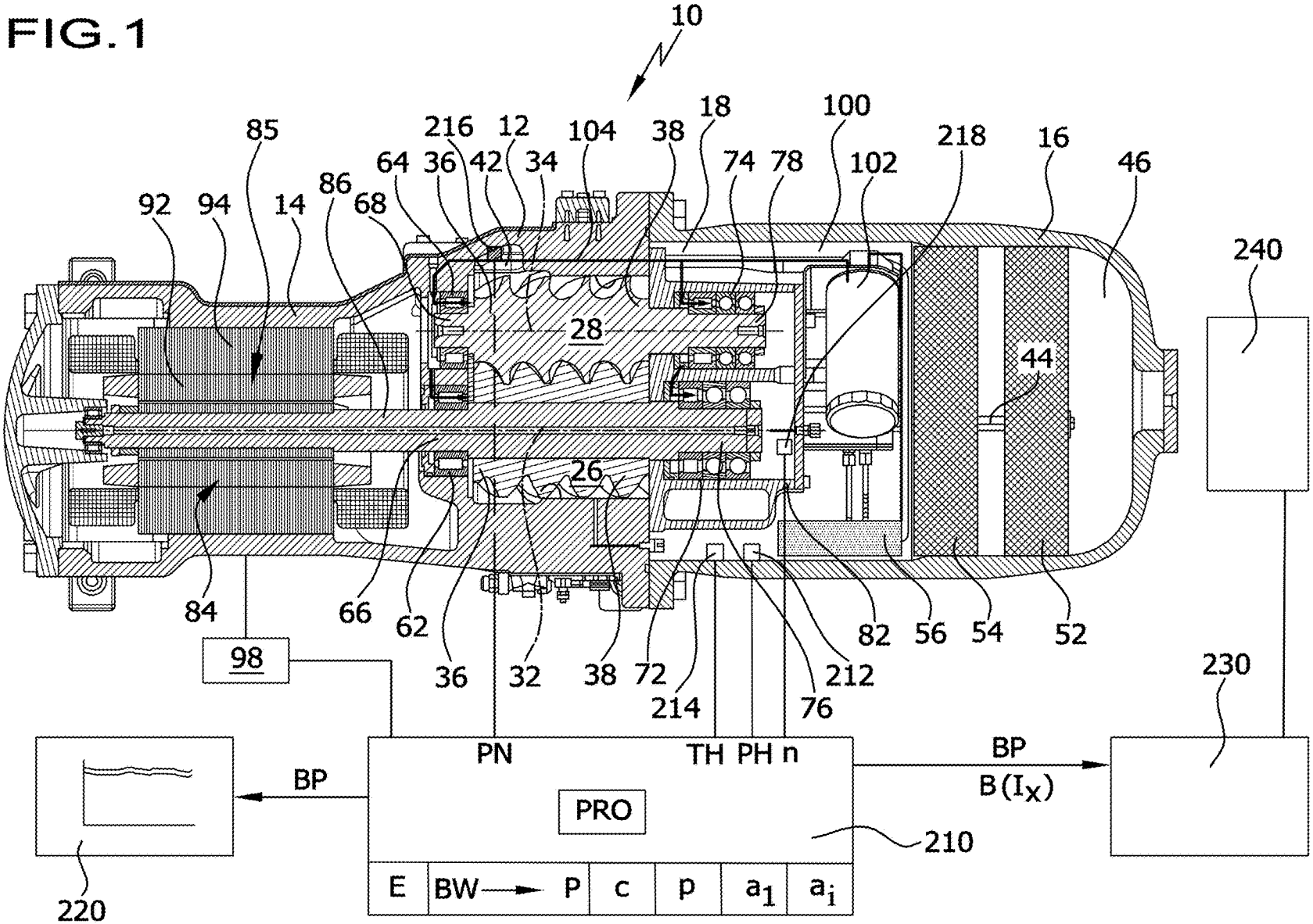
FIG. 1 shows a longitudinal section of an exemplary embodiment of a refrigerant compressor/expander according to the invention with components according to the invention cooperating therewith.
Figure 2:
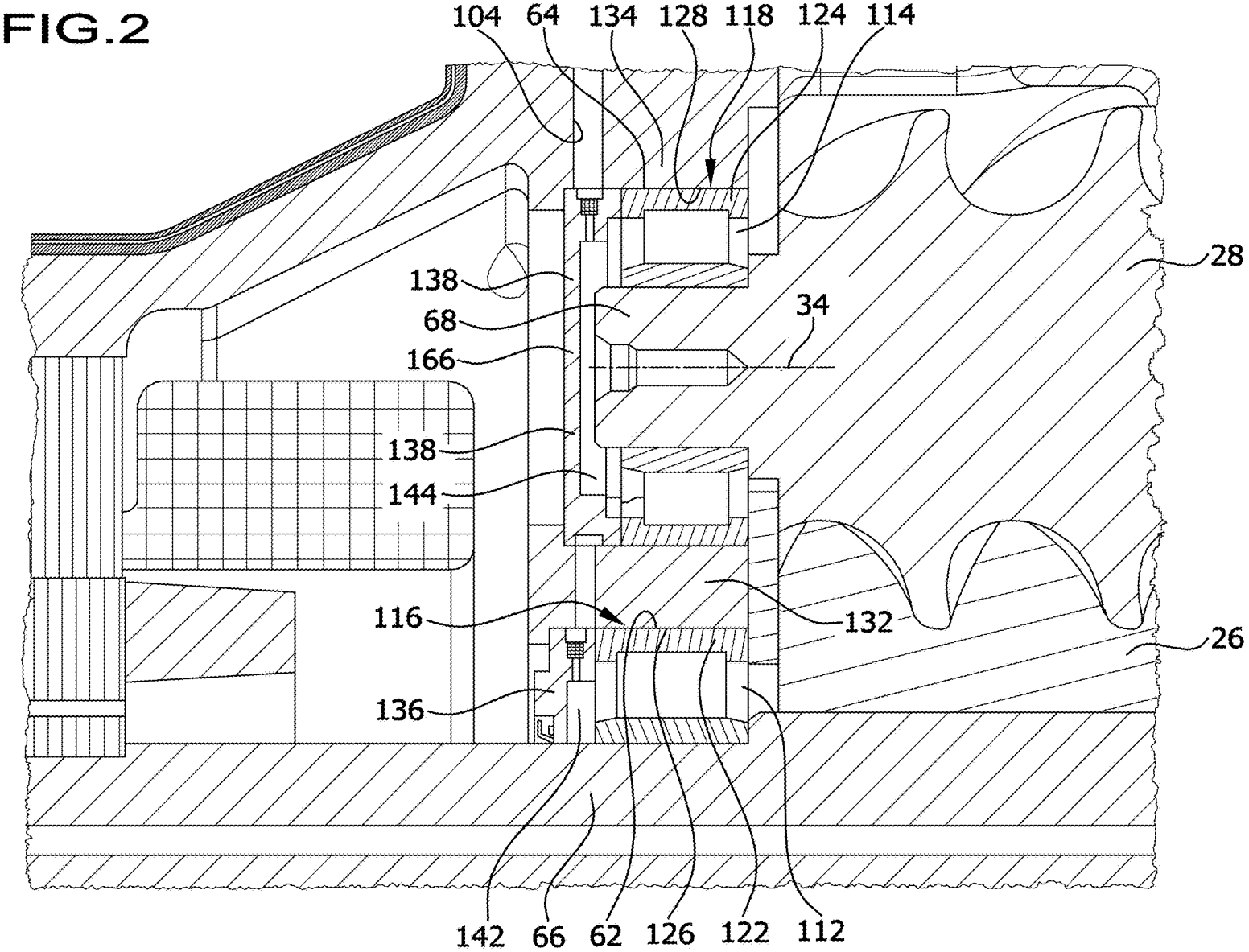
FIG. 2 shows an enlarged detail view through the refrigerant compressor/expander in the region of bearing units on the low-pressure side.

An exemplary embodiment shown in FIG. 1 of a refrigerant compressor/expander according to the invention comprises an overall housing 10, which has a compressor housing 12 with a pressure housing 16 and for example a motor housing 14 arranged on a side of the compressor housing 12 opposite the pressure housing 16.

The compressor housing 12 is part of a compressor unit 18 and provided therein are, as an example for a compressor unit which could also be a positive displacement compressor or a scroll compressor, receiving bores 22, 24 for screw rotors 26 and 28 respectively, which are mounted in the receiving bores 22, 24 rotatably about respective axes 32, 34.

The screw rotors 26, 28 extend here from a low-pressure side 36 to a high-pressure side 38 of the compressor unit 18, wherein a refrigerant supply channel 42 is associated with the low-pressure side 36, whereas on the high-pressure side 38 there is provided a high-pressure outlet, not shown in FIG. 1, starting from which the compressed refrigerant enters the pressure housing 16 via an outflow channel 44, more specifically enters an end-side chamber 46, from which the refrigerant then passes through two lubricant separators 52, 54, which are arranged in the pressure housing 16 and by means of which the lubricant is separated from the compressed refrigerant and is fed to an oil sump 56 arranged in the pressure housing 16, in addition the refrigerant compressed to high pressure exiting the pressure housing 16 through a high-pressure outlet, not shown.

The screw rotors 26, 28 are mounted in the region of the low-pressure side 36 of the screw rotors 26, 28 by bearing units 62, 64, which are arranged in the compressor housing 12 and which support bearing shaft portions 66, 68 of the screw rotors 26, 28.

The screw rotors 26, 28 are further mounted in the region of their high-pressure side by bearing units 72, 74, which likewise support shaft portions 76, 78 of the screw rotors 26, 28.

The bearing units 72, 74 are arranged here in a high-pressure-side bearing housing 82 of the compressor unit 18, which is fixedly connected to the compressor housing 12 and following the compressor housing 12 projects into the pressure housing 16.

The screw rotors 26, 28 are driven by a drive unit 84 arranged in the motor housing 14, in particular a drive motor 85, the motor shaft 86 of which transitions for example in one piece into the bearing shaft portion 66 and carries a rotor 92, which in this exemplary embodiment is likewise rotatable coaxially with the rotation axis 32 of the bearing shaft portion 66.

The drive motor 85 also comprises a stator 94, which is arranged non-rotatably in the motor housing 14.

The drive motor is actuated for example by a frequency converter 98.

In the shown exemplary embodiment of the refrigerant compressor/expander according to the invention, for example the drawn-in refrigerant flows firstly through the motor housing 14 in order to cool the rotor 92 and the stator 94 and then passes into the refrigerant supply channel 42, which supplies the refrigerant that is to be drawn in to the low-pressure side 36 of the screw rotors 26, 28.

To lubricate all bearing units 62, 64 and 72, 74 as well as also the screw rotors 26, 28 in the receiving bores 22, 24, a lubricant supply system denoted as a whole by 100 is provided, which receives lubricant from the lubricant sump 56, which is at high pressure, supplies it to a filter unit 102, and then supplies the lubricant from the filter unit 102 to the individual bearing units 62, 64, 72, 74.

In particular, the lubricant supply system 100 comprises a lubricant distribution system 104 leading from the filter unit 102 to the bearing units 62, 64.

In order to be able to lubricate the bearing units 62, 64 optimally by the lubricant distribution system 104, roller bearings 112, 114 receiving the bearing shaft portions 66, 68 rotatably are arranged in bearing housings 116, 118 respectively, which on one side are formed by wall regions 132, 134 of the compressor housing 12 which receive bearing outer races 122, 124 of the roller bearings 112, 114 and are provided with receiving bores 126, 128 and on a side facing away from the corresponding screw rotor 26, 28 are closed by bearing housing covers 136, 138, so that lubricant chambers 142, 144 are present in the bearing housings 116, 118 and are supplied with the lubricant for lubricating the roller bearings 112, 114.

On the one hand, lubricant is to be fed to these lubricant chambers 142, 144 in sufficient quantity in order to be able to ensure reliable and permanent lubrication of the roller bearings 112, 114, but on the other hand too much lubricant supplied to the lubricant chambers 142, 144 leads to losses caused by the lubricant splashing or being squeezed out in the region of the roller bearings 112, 114, resulting in an increase of the power consumption of the drive motor 84 and thus a reduction in the coefficient of performance of the refrigerant compressor/expander.

Figure 3:
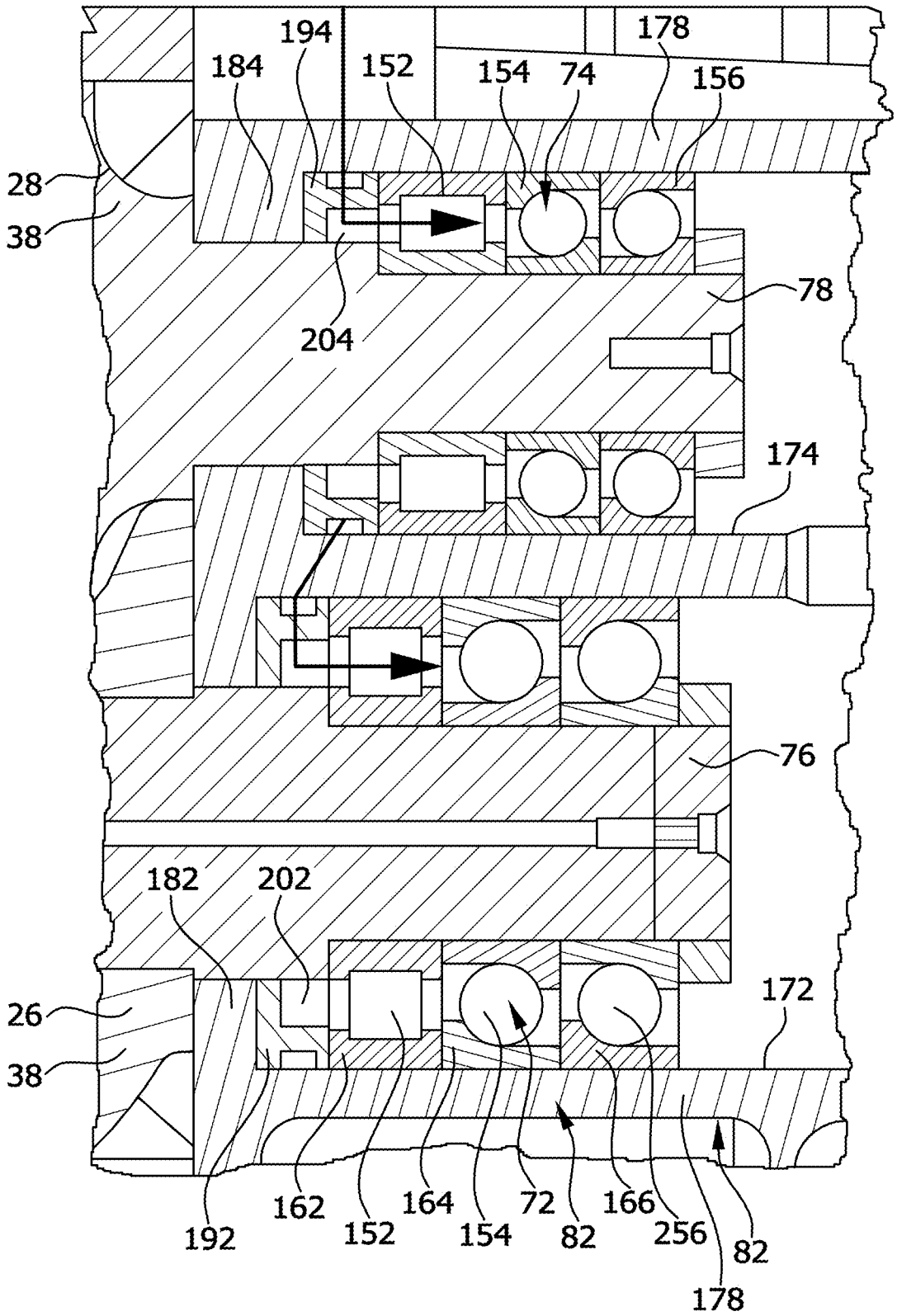
FIG. 3 shows a section through the exemplary embodiment of the refrigerant compressor/expander according to the invention in the region of bearing units on the high-pressure side.

As shown in FIG. 1 and on an enlarged scale in FIG. 3, each of the bearing units 72 and 74 additionally comprises a set of roller bearings 152, 154 and 156, which are arranged in the high-pressure-side bearing housing denoted as a whole by 82 and sit with their bearing outer races 162, 164, 166 in receiving bores 172 and 174 of the bearing housing 82 provided for this purpose, the receiving bores 172, 174 being surrounded by wall regions 176, 178 of the high-pressure-side bearing housing 82 and additionally being delimited on their side facing the high-pressure side 38 of the screw rotors 26, 28 by wall regions 182, 184, which are penetrated by the shaft portions 76 and 78 and provide a seal therewith, so that the wall regions 182, 184 form a tight closure between the high-pressure sides 38 of the screw rotors 26, 28 and the receiving bores 172, 174.

Bearing housing rings 192, 194 inserted into the receiving bores 172, 174 sit on the sides of the wall regions 182, 184 opposite the high-pressure sides 38 of the screw rotors 26, 28 and are thus arranged between the corresponding wall regions 182, 184 and the roller bearing 202 that is closest in each case.

Such bearing housing rings 192, 194 can be arranged either, as shown in FIGS. 1 and 3, on the end side of the roller bearings 152, 154, 156 or between two of the roller bearings 152, 154, 156.

The bearing housing rings 192, 194 delimit lubricant chambers 202, 204 arranged between them and the closest roller bearings 152, with a lubricant feed to the roller bearings 152, 154 and 156 starting from said lubricant chambers and passing for example through the corresponding bearing.

It is therefore necessary to ensure a metered supply of lubricant from the lubricant distribution system 104.

For example, the roller bearings 152 are formed as radial bearings and the roller bearings 154, 156 are formed as axial bearings.

To determine the operating status of a refrigerant compressor/expander, for example of the above-described exemplary embodiment of the refrigerant compressor/expander according to the invention, a bearing, in particular a roller bearing, of one of the bearing units 62, 64, 72 or 74 is selected, preferably the lowest-dimensioned bearing, and a future maintenance-free operating period for this bearing is determined.

By way of example, the roller bearing 152 formed as a radial bearing is selected for the screw rotor 28 and is smaller than the radial bearing 152 for the screw rotor 26.

To determine the future maintenance-free operating period, a load value BW of the refrigerant compressor/expander 10 is determined by means of an operating status determination module 210, the operating status determination module 210 being connected to a pressure sensor 212, which measures a pressure PH of the compressed refrigerant, and is connected to a temperature sensor 214, which measures a temperature TH of the compressed refrigerant.

For example, the pressure sensor 212 and the temperature sensor 214 can be arranged in the outflow channel 44 or in the pressure housing 16.

Furthermore, the operating status determination module 210 is also connected to a pressure sensor 216, which is arranged for example in the refrigerant supply channel 42 and measures a pressure PN on the low-pressure side of the refrigerant compressor/expander.

In addition, the operating status determination module 210 is connected to a speed sensor 218, which measures a speed of the screw rotors 24, 28, in the shown exemplary embodiment a speed n of the screw rotors 26, 28, for example a speed n of the shaft portion 76 of the screw rotor 26.

Alternatively or additionally, the operating status determination module 210 is connected to the frequency converter 98 in order to detect the speed and optionally the power consumption.

Figure 4:
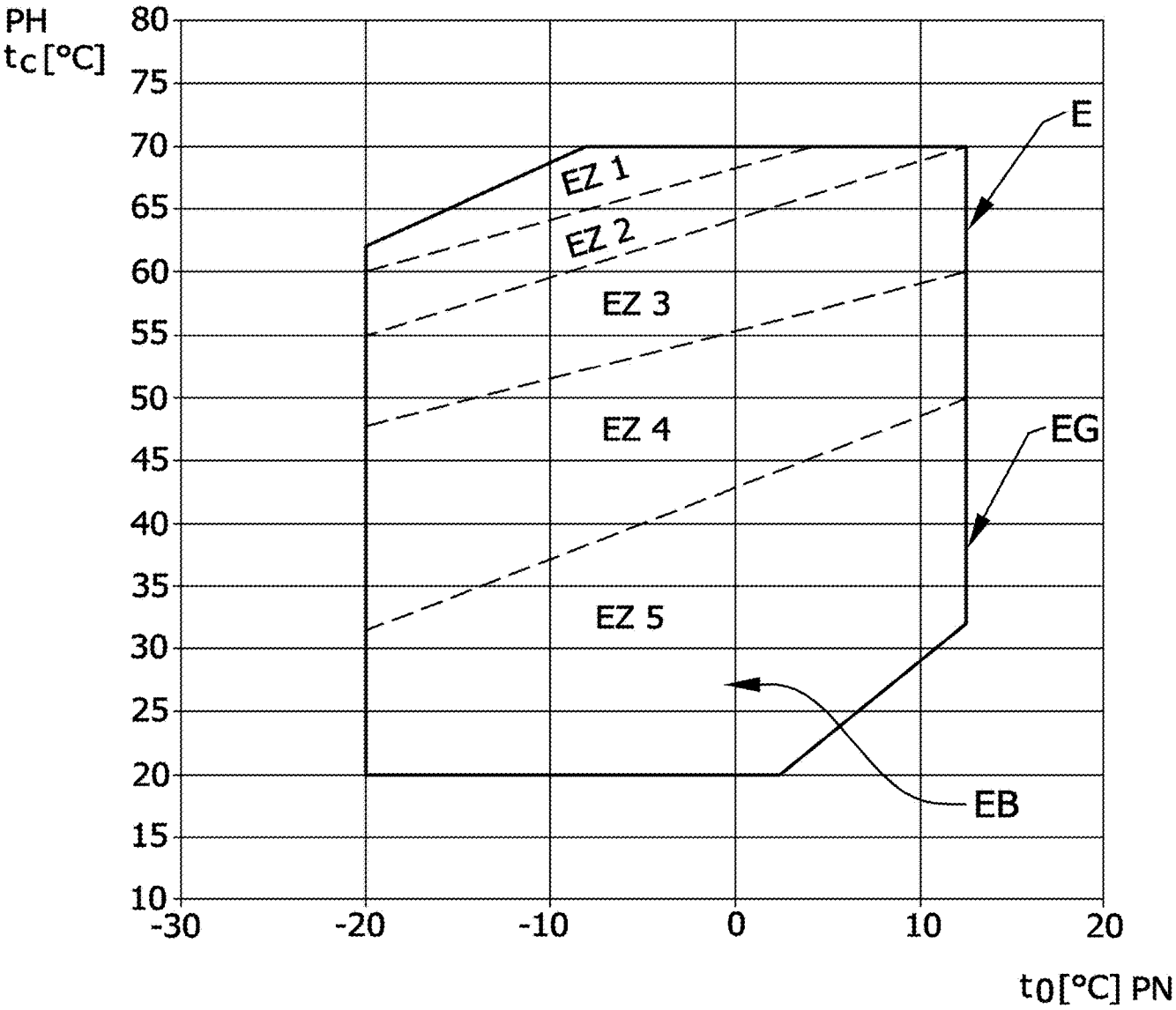
FIG. 4 shows an exemplary illustration of an operating diagram for an exemplary refrigerant with plotted operating zones.

For the determination of a load value BW of the compressor unit 18, an operating diagram E shown in FIG. 4 is consulted by a processor PRO of the operating status determination module 210 and specifies, by predefined operating limits EG, an operating range EB of the compressor unit 18, which defines at what values of the condensation temperature $T_c$ of the refrigeration plant, calculated from the value PH for the high pressure, and at what values of the evaporation temperature $t_o$, calculated from the value PN for the low pressure, the compressor unit can be operated.

Here, for example, the particular value pairing PH/PN with which the compressor unit 18 is operated could be consulted for the determination of the load value BW.

For reasons of simplification, it is provided to divide the operating range EB into individual operating zones EZ1, EZ2, EZ3, EZ4 and EZ5, such that the operation of the compressor unit 18 within the operating range EB can thus be detected in a simplified way.

Here, the operating zone EZ1 represents the zone with the highest load and the operating zones EZ2, EZ3, EZ4 and EZ5 represent zones with increasingly lower load.

A load value BW1, BW2, BW3, BW4 and BW5 is associated with each of these operating zones EZ1, EZ2, EZ3, EZ4 and EZ5 and is representative for the load of the compressor unit and thus also for the mechanical load of the considered bearing, for example in this case of the selected radial bearing 152 for the screw rotor 26.

With regard to the consulted operating diagram E it should be noted that the operating diagram E and in particular the operating limits EG and the operating range EB enclosed thereby is dependent on the particular refrigerant that is used in the compressor unit 18, such that the data of the refrigerant are stored in the operating status determination module 210.

The load values BW1 to BW5 are associated with the operating zones EZ1 to EZ5 for example by way of tests or by way of calculations taking into account the geometric conditions under which a compressor unit 18 to be considered is operated in the operating zones EZ1, EZ2, EZ3, EZ4 and EZ5, and the wear of the selected bearing is analyzed subsequently.

It is also possible to also detect partial load operating statuses of the refrigerant compressor/expander by means of the load values BW1 to BW5 associated with the operating zones EZ1 to EZ5.

For this reason, the determined load values BW1 to BW5 are stored in the operating status determination module 210 for the operating zones EZ1 to EZ5.

Figure 5:
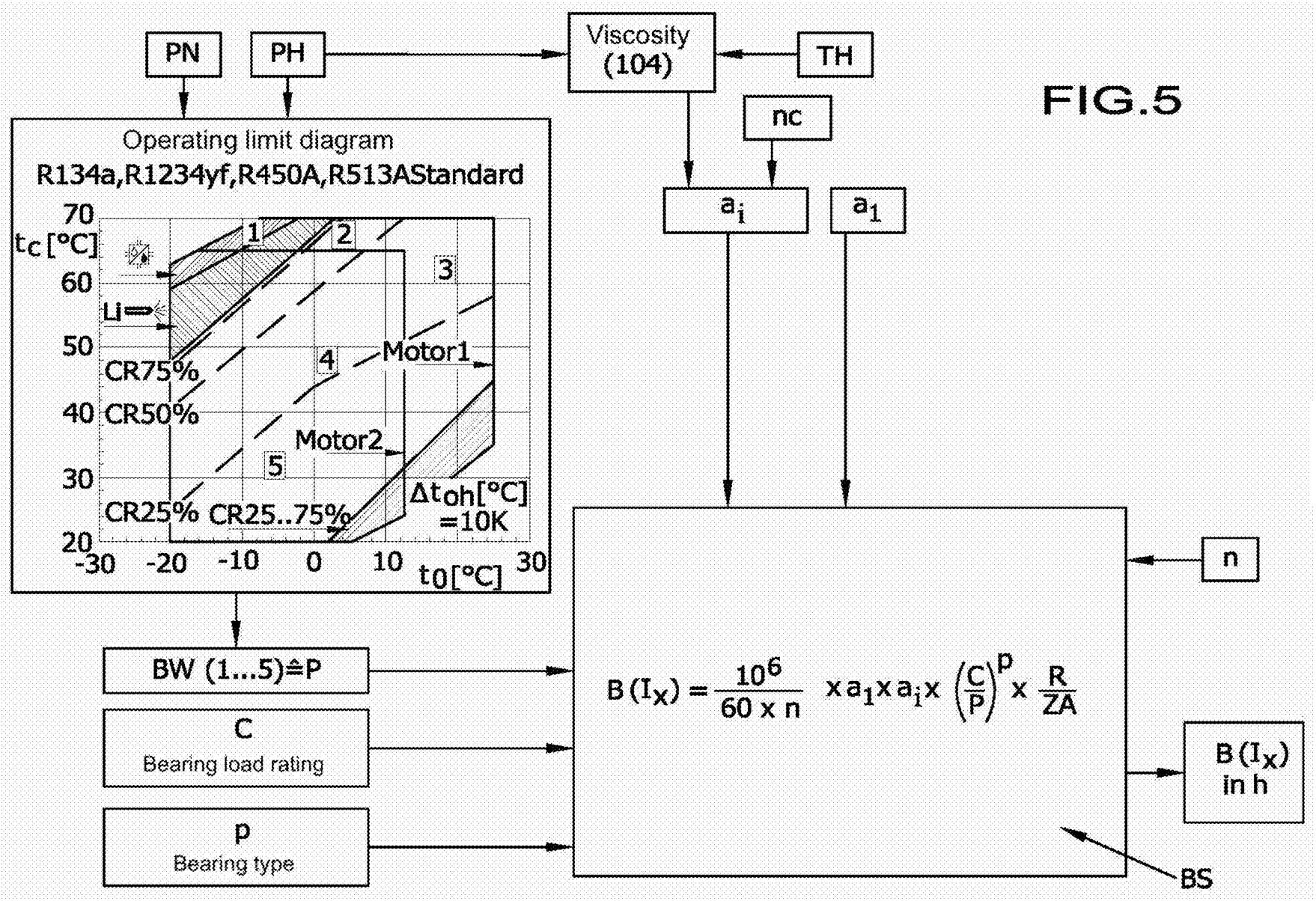
FIG. 5 shows a schematic illustration of a determination according to the invention of an operating period in an operating interval of the operation.

Here, the determined load value BW1 to BW5 is determined in particular such that it can be used as the value P for the bearing load in the formula according to DIN ISO 281:1990 for the bearing service life of roller bearings, corresponding to the value P of this formula usable for the bearing load, so that, as shown in FIG. 5, the service life of the bearing is calculated in hours by the operating status determination module 210 in a calculation step BS according to the formula DIN ISO 281:1990 shown by way of example in FIG. 5, the speed n of the bearing also being taken into account in this calculation step BS in addition to the bearing load P.

This service life of the selected bearing is used to determine the operating period B of the refrigerant compressor/expander 10, in the simplest case is equated thereto.

In addition, the formula according to the calculation step BS takes into account a load rating of the bearing C, specified by the bearing manufacturer, and also a bearing-typical exponent p, which by way of example is 3 for ball bearings and 10/3 for roller bearings, and additionally also a factor or coefficient $a_1$ for the probability of failure, which likewise is specified by the bearing manufacturer, and also a factor or coefficient $a_i$, which is dependent on the materials of the bearing and on the operating conditions.

Figure 6:
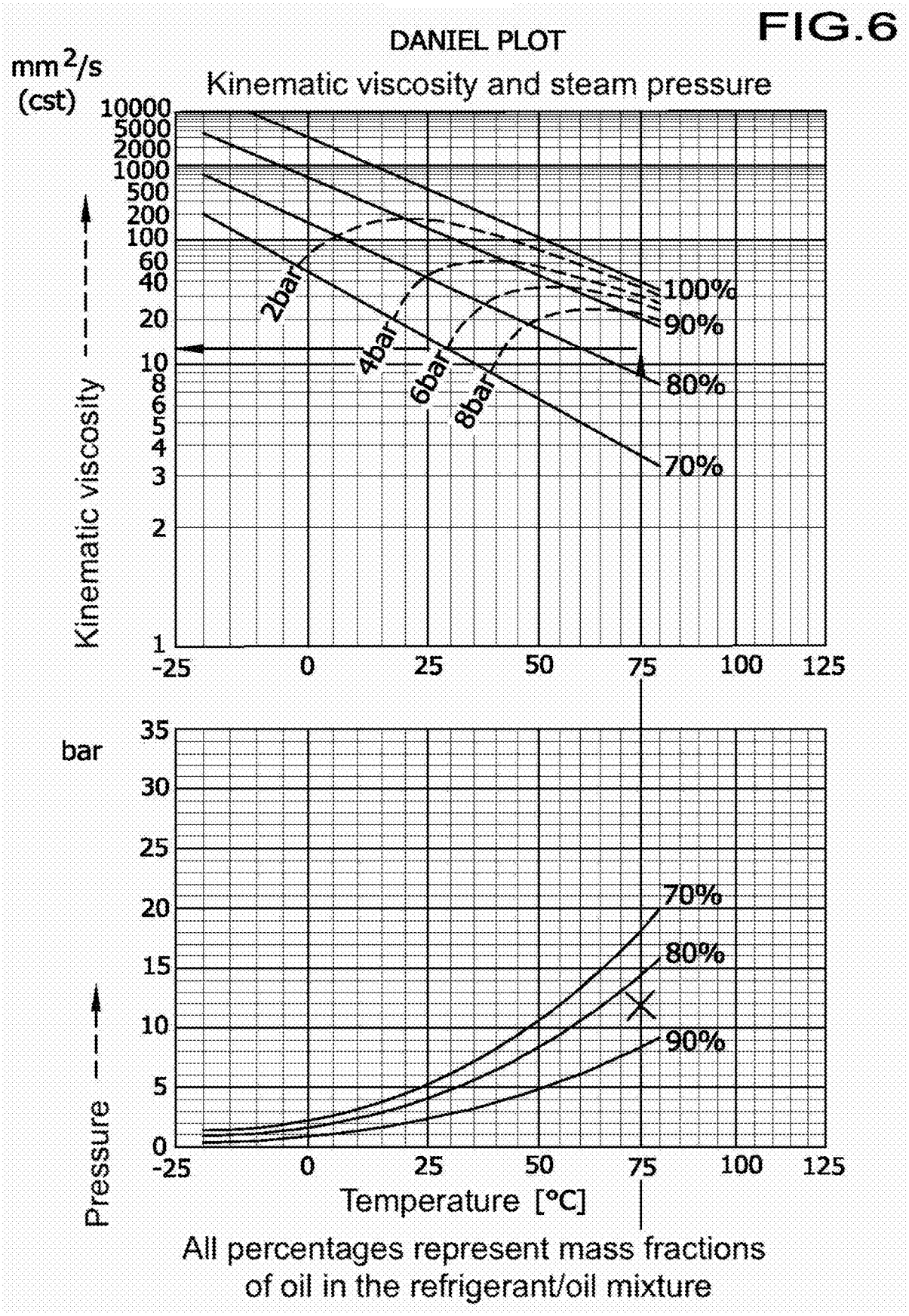
FIG. 6 shows an exemplary illustration of a Daniel plot for determining an operating parameter representative for the lubricant.

The factor or coefficient $a_i$ is also dependent, amongst other things, on the viscosity of the lubricant in the lubricant distribution system 104, the viscosity of the lubricant being dependent on the high pressure PH measured by the pressure sensor 212 and on the high-pressure-side temperature TH measured by the temperature sensor 214, on the basis of which it is possible to determine the percentage of refrigerant contained in the lubricant by means of a so-called Daniel plot according to FIG. 6.

With the aid of the Daniel plot, the viscosity of the lubricant can then be determined on the basis of the proportion of refrigerant dissolved in the lubricant, as is shown by way of example for an exemplary refrigerant in FIG. 6.

If a lubricant is used in which no refrigerant is incorporated, the viscosity of the lubricant can be used directly.

The factor or coefficient $a_i$, however, not only includes the viscosity of the lubricant, but also a contamination coefficient nc, which is determined experimentally in tests for the particular compressor unit 18 and the particular lubricant.

In the calculation step BS shown in FIG. 5, if this were to take into account only the factors for the bearing service life according to DIN ISO 281:1990, the number ZA of the start-ups of the refrigerant compressor/expander 10 following downtime would not be taken into account, but also affects the bearing service life.

For this reason, a possible solution provides that the load value BW is increased after a defined number ZA of start-ups.

Another possibility shown in FIG. 5 provides, in order to determine the operating period B, multiplying the variables included in the calculation step BS by a factor that represents a quotient of a reduction factor R, specified in accordance with the configuration of the refrigerant compressor/expander, for example determined experimentally, and the number ZA of start-ups, such that the factor is $$\frac{R}{ZA}.$$

For example, the reduction factor R with use of a frequency converter is greater, preferably by a factor in the range of 10 to 100, than the reduction factor R in the case of a switched start-up.

The calculation step BS shown in FIG. 5 is suitable, for a single load value BW and a single speed n, for determining the service life of the selected bearing and consequently the operating period B of the refrigerant compressor/expander 10.

In the case of the refrigerant compressor/expanders 10 according to the invention, however, it is to be assumed that the compressor units 18 are not operated continuously at the same operating point within the operating range EB, but instead the operating points within the operating range EB vary and in addition the refrigerant compressor/expander switches on and off.

Figure 7:
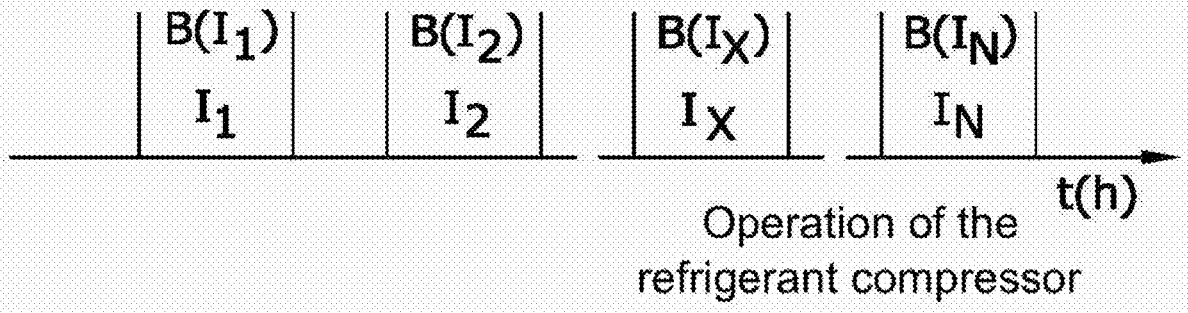
FIG. 7 shows a schematic illustration of operation of the refrigerant compressor/expander in successive time intervals and the operating periods associated with these time intervals.

For this reason, the operating status determination module 210 determines the value for the operating period of the refrigerant compressor/expander on the basis of the selected bearing, for example the radial bearing 152 for the screw rotor 26, and thus also the operating period B for each individual successive time interval $I_x$ in which the refrigerant compressor/expander 10 is operated, the time intervals ($I_x$) lying for example in the range of from 30 minutes to several hours (FIG. 7).

Here, following the expiry of a time interval $I_x$, the load value BW or an averaging of the load value BW within the particular time interval $I_x$ can be detected.

Likewise, following the expiry of a time interval $I_x$, the speed n or an averaging of the speed n over the particular time interval $I_x$ can be detected.

After each time interval $I_x$, there is thus available a value $B(I_x)$ for the operating period determined in this time interval.

To determine the operating prediction value BP, this value of the operating period $B(I_x)$ for the operating period $B(I_x)$ determined in each of these time intervals $I_x$ is then set in relation to an operating period limit value BG, for example the maximum operating period at maximum load value BW1 of the bearing in the operating zone EZ1 and maximum speed n, and then an operating period correction value BR is then deducted from this operating period limit value BG for each time interval ($I_x$), the operating period correction value being given from the operating period limit value BG divided by the operating period $B(I_x)$ determined in the particular time interval $I_x$ and multiplied by the duration t of the time interval $I_x$.

$$BP = BG - \sum_{x=1}^{n} BR(x) = BG - \sum_{x=1}^{n} \frac{BG}{B(I_x)} \cdot t(x)$$

The operating period limit value BG, however, can also be selected such that it corresponds to the maximum operating period at minimal load in the operating zone EZ5 and minimal speed n, or a selected value of the maximum operating period at a load between the operating zone EZ1 and the operating zone EZ5 as well as a speed n between the maximum and the minimum speed n, such that in particular the optimal operating period limit value BG is determined by way of tests.

This operating prediction value BP can be output by the operating status determination module 210 on a display unit 220, and can be presented thereby either numerically or in any way graphically, for example in the form of a bar chart.

In addition, it is also possible, if, for example, the operating prediction value BP falls below a limit value for the maintenance GW, to output a maintenance recommendation by the operating status determination module 210.

The operating status determination module 210, however, can also be used to store the operating prediction value BP or also the values for the operating period $B(I_x)$ detected for the particular time intervals $I_x$ in an external storage medium 230, for example a memory of the operator of the refrigerant compressor/expander or of the supplier or manufacturer of the refrigerant compressor/expander 10.

If, for example, the supplier or manufacturer of the refrigerant compressor/expander has access to the external memory 230, they may likewise determine the load of the refrigerant compressor/expander 10, in particular of the compressor unit 18, on the basis of the values $B(I_x)$ known to them, and for example may give maintenance recommendations or may give recommendations for other operating materials, for example other refrigerants or other lubricants, which in view of the actual loads of the compressor unit 18 allow optimized maintenance intervals, for example longer maintenance intervals, or may possibly even propose other bearings.

The supplier or manufacturer of the refrigerant compressor/expander thus likewise has the possibility to analyze the operation of the refrigerant compressor/expander and, if necessary, to schedule on its part maintenance intervals for this refrigerant compressor/expander (predictive maintenance).

The manufacturer of the refrigerant compressor/expander, however, may also determine more optimal operating conditions for the refrigerant compressor/expander on the basis of the operating period prediction BP and the operating periods B determined for the individual time intervals, for example by simulations.

For example, the manufacturer of the refrigerant compressor/expander may use a virtual bearing for an analysis and may determine an operating prediction value BP on the basis of the optimized or virtual bearing and may compare this with the operating prediction value obtained from the refrigerant compressor/expander.

Alternatively or additionally, the manufacturer of the refrigerant compressor/expander may also compare the operating prediction value BP with virtually determined operating prediction values from virtual operating data.

Virtual operating parameters of this kind can be provided, for example, from other refrigerants or other lubricants, with which the possibility exists virtually to determine an operating prediction value BP which is then compared with the operating prediction value BP of the refrigerant compressor/expander actually in use in order to analyze whether an optimization of the maintenance intervals is possible on the basis of the other operating parameters.

In addition, the data stored in the external memory 230 can be used by a superordinate controller 240 of the operator of the refrigerant compressor/expander 10 in order to monitor and/or to optimize the operation of the refrigerant compressor/expander.

It can thus also be identified in the superordinate control and/or monitoring unit 240 from the operating prediction value BP what further operating period can be realized with this refrigerant compressor/expander.

For example, when using a plurality of refrigerant compressors/expanders, the control and/or monitoring unit can operate the refrigerant compressor/expander having the best operating period prediction BP in an intensified manner and for example can operate a refrigerant compressor/expander having a lower operating period prediction BP less intensively, in order to thus synchronize the maintenance intervals for example in the case of multiple compressors.

In addition, the external memory can also be used to transmit the operating period prediction BP to further communication units of the operator, optionally also mobile communication devices of the operator of the refrigerant compressor/expander.

The invention claimed is:

1. A method for operating status determination of a refrigerant compressor/expander comprising a compressor unit and a drive unit, wherein, for at least one bearing of the refrigerant compressor/expander, a load value resulting from an operation of said refrigerant compressor/expander and a speed value are determined, and wherein, on the basis of the speed value and the load value and also at least one operating parameter, there is determined for the at least one bearing an operating prediction value for a future maintenance-free operation of the refrigerant compressor/expander; and wherein an operating period reduction value is determined for each time interval from a value for an operating period, and wherein the sum of all operating period reduction values of all time intervals is subtracted from a predefined operating period limit value;

wherein the refrigerant compressor/expander is controlled based on the operating prediction value.

2. The method in accordance with claim 1, wherein the load value of the at least one bearing is determined taking into account at least one of i) pressure values and ii) temperature values of the refrigerant compressor/expander.

3. The method in accordance with claim 1, wherein the load value of the bearing is determined by detecting at least one of i) pressure values and ii) temperature values on a high-pressure side of the refrigerant compressor/expander and at least one of i) pressure values and ii) temperature values on a low-pressure side of the refrigerant compressor/expander.

4. The method in accordance with claim 1, wherein the load value of the at least one bearing is determined taking into account the operation of the refrigerant compressor/expander for a plurality of statuses within an operating diagram.

5. The method in accordance with claim 1, wherein an operating diagram is divided within a plurality of operating limits into a plurality of operating zones having load values associated with them, and wherein, within the various operating zones, the load values associated with these operating zones are consulted during operation of the refrigerant compressor/expander.

6. The method in accordance with claim 1, wherein, on the basis of load values occurring in conjunction with defined time intervals of the operation of the refrigerant compressor/expander, values for an operating period associated with these time intervals are determined.

7. The method in accordance with claim 1, wherein, on the basis of speed values occurring in conjunction with time intervals of the operation of the refrigerant compressor/expander, values for an operating period associated with these time intervals are determined.

8. The method in accordance with claim 1, wherein the operating prediction value is determined from the values for the operating period for various successive time intervals.

9. The method in accordance with claim 1, wherein the operating period reduction value is based on a division of the predefined operating period limit value by the operating period.

10. The method in accordance with claim 1, wherein the operating period reduction value is determined by division of the predefined operating period limit value by the operating period multiplied by the duration of said each time interval.

11. The method in accordance with claim 1, wherein a lubricant-specific lubricant parameter is taken into account as an operating parameter when determining the operating prediction value.

12. The method in accordance with claim 11, wherein the lubricant-specific lubricant parameter is determined on the basis of at least one of i) a pressure and ii) a temperature on a high-pressure side of the refrigerant compressor/expander.

13. The method in accordance with claim 11, wherein the lubricant-specific lubricant parameter is determined on the basis of a lubricant viscosity.

14. The method in accordance with claim 1, wherein, when determining the operating prediction value, at least one bearing parameter of the at least one selected bearing is taken into account as operating parameter.

15. The method in accordance with claim 14, wherein the at least one bearing parameter for the at least one selected bearing comprises at least one parameter selected from the following parameters: service life parameter, load rating parameter, and bearing type parameter.

16. The method in accordance with claim 1, wherein the at least one selected bearing is a bearing that takes up forces occurring during the compression of the refrigerant.

17. The method in accordance with claim 1, wherein the at least one selected bearing is the bearing of the refrigerant compressor/expander with the highest mechanical load.

18. The method in accordance with claim 1, wherein the at least one selected bearing is the bearing with the shortest service life.

19. The method in accordance with claim 1, wherein the at least one selected bearing is the bearing with the smallest diameter.

20. The method in accordance with claim 1, wherein at least one of i) the operating prediction value and ii) the operating periods determined for the individual time intervals are made available in an external memory.

21. The method in accordance with claim 1, wherein the operating prediction value is displayed on a display unit.

22. The method in accordance with claim 1, wherein the operating prediction value is transmitted to at least one of i) a superordinate control and ii) a monitoring unit.

23. The method in accordance with claim 1, wherein the operating prediction value is made accessible to the manufacturer of the refrigerant compressor/expander.

24. The method in accordance with claim 1, wherein the operating prediction value is compared with operating prediction values of a virtual bearing.

25. The method in accordance with claim 1, wherein the operating prediction value is compared with virtual operating prediction values from virtual operating parameters.

26. The method according to claim 1, wherein controlling the refrigerant compressor/expander based on the operating prediction value comprises controlling an operating mode of the refrigerant compressor/expander.

* * * * *